United States Patent [19]

Knape

[11] 4,311,280

[45] Jan. 19, 1982

[54] ELECTROMAGNETIC FUEL INJECTOR WITH ADJUSTABLE ARMATURE SPRING

[75] Inventor: Richard S. Knape, Grand Rapids, Mich.

[73] Assignee: General Motors Corporation, Detroit, Mich.

[21] Appl. No.: 170,746

[22] Filed: Jul. 21, 1980

[51] Int. Cl.[3] ..... F02M 51/06

[52] U.S. Cl. ..... 239/585; 251/141

[58] Field of Search ..... 239/585; 267/175, 177; 251/129, 141

[56] References Cited

U.S. PATENT DOCUMENTS

| | | | |
|---|---|---|---|
| 2,980,090 | 4/1961 | Sutton et al. | 123/119 |
| 3,653,630 | 4/1972 | Ritsema | 251/129 |
| 3,662,987 | 5/1972 | Schlagmuller et al. | 251/139 |
| 3,738,578 | 6/1973 | Farrell | 239/585 |
| 4,008,876 | 2/1977 | Bastle | 251/129 |
| 4,156,506 | 5/1979 | Locke et al. | 239/585 |
| 4,218,021 | 8/1980 | Palma | 239/585 |
| 4,247,052 | 1/1981 | Gray | 239/585 |

FOREIGN PATENT DOCUMENTS 698160 11/1964 Canada ..... 251/141

*Primary Examiner*—Andres Kashnikow

*Attorney, Agent, or Firm*—Arthur N. Krein

[57] ABSTRACT

An electromagnetic fuel injector has an axially extending guide pin fixed to an armature and slidably received in the solenoid pole piece to axially guide the armature during its movement thereof relative to the solenoid pole piece. The guide pin has a sleeve supported thereon for engagement at one end with a surface of the armature and extending at its opposite end axially outboard the armature for abutment against the solenoid pole piece whereby to serve as an abutment stop so as to establish a predetermined minimum working air gap between the opposed working surfaces of the armature and an associated solenoid pole piece. An armature return spring has one end thereof in abutment with a free end of the guide pin to bias the armature in an axial direction away from the solenoid pole piece and has its opposite end in abutment against an externally accessible abutment screw whereby the force of the armature return spring can be adjusted as desired. In a preferred embodiment, an additional spring is operatively positioned to assist the armature return spring.

3 Claims, 1 Drawing Figure

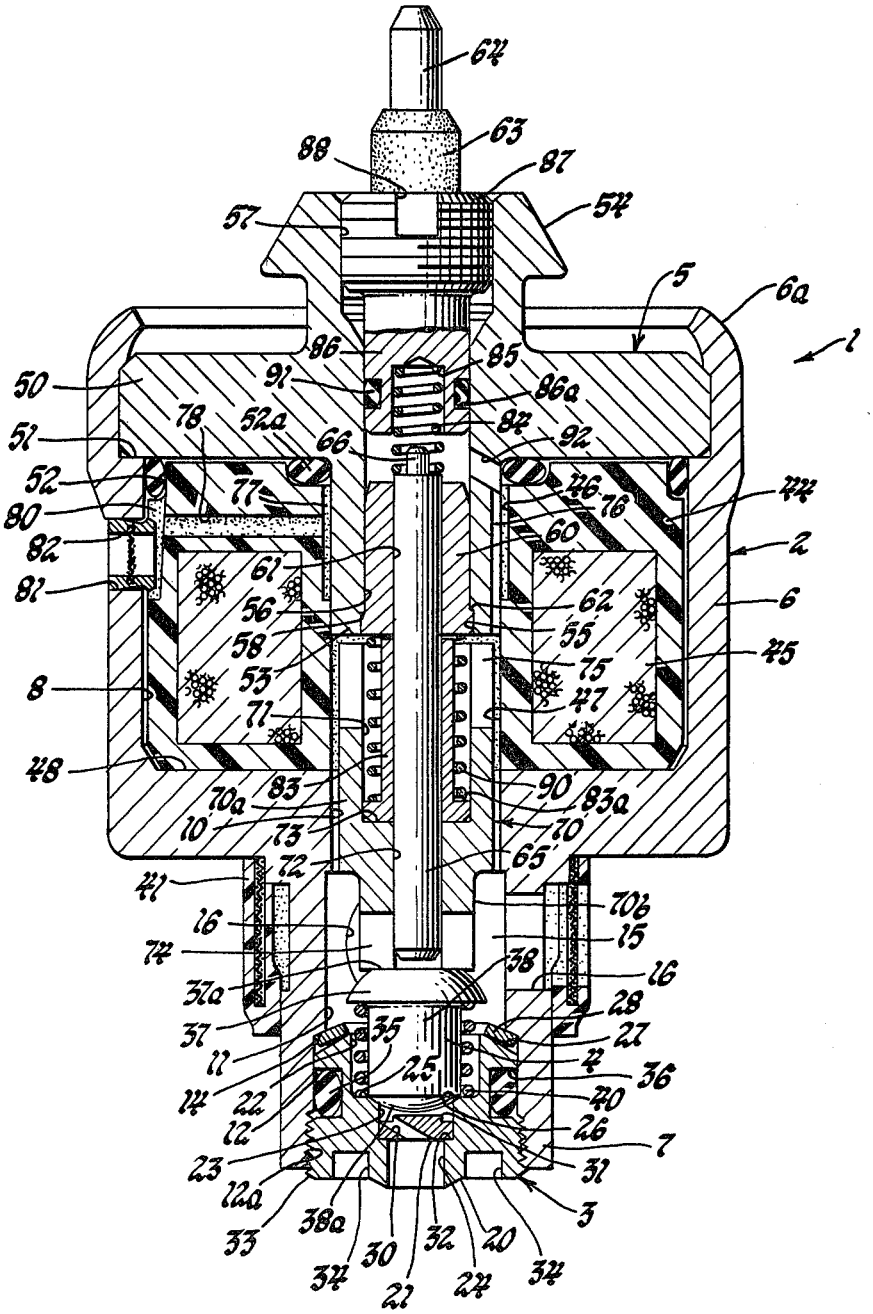
64
63
88
87
57
54
5
6a
1
86
85
91
86a
50
87
92
51
78
52a
66
52
77
76
74
80
76
60
82
2
81
61
62
6
56
55
58
75
45
8
53
47
71
48
90
70a
83
83a
10
73
70
72
65
41
70b
16
15
74
38
16
37a
28
37
35
27
11
4
36
14
22
25
40
12
26
7
23
31
12a
3
33
38a
30
32
20
34
21
24
34

ELECTROMAGNETIC FUEL INJECTOR WITH ADJUSTABLE ARMATURE SPRING

FIELD OF THE INVENTION

This invention relates to electromagnetic fuel injectors and, in particular, to such an injector having means therein to provide a minimum fixed working air gap and externally accessible means for adjusting the bias of the armature return spring means.

DESCRIPTION OF THE PRIOR ART

Electromagnetic fuel injectors are used in fuel injection systems for vehicle engines because of the capability of this type injector to more effectively control the discharge of a precise metered quantity of fuel per unit of time to an engine. Such electromagnetic fuel injectors, as used in vehicle engines, are normally calibrated so as to inject a predetermined quantity of fuel per unit of time prior to their installation in the fuel system for a particular engine.

In one such type electromagnetic fuel injector which is presently used in a fuel system of the type shown in U.S. Pat. No. 4,186,708 entitled "Fuel Injection Apparatus With Wetting Action" issued Feb. 5, 1980 to Lauren L. Bowler, that is presently in use in commerically available passenger vehicles, a two-part valve means movable relative to an annular valve seat is used to open and close a passage for the delivery of fuel from the injector out through an injection nozzle having delivery orifices downstream of the valve seat. One part of this valve means is a sphere-like valve member having a flat on one side thereof and being spherical opposite the flat to provide a spherical seating surface for valve closing engagement with the valve seat. The other part of the valve means is an armature with a flat end face seated against the flat surface of the valve member in a laterally slidable engagement therewith.

In this type injector, the armature is provided with an axial through guide bore to slidably receive a fixed, axially extending guide pin. An armature spring is positioned within the injector to normally bias the armature in a direction to effect seating of the valve member against the valve seat. A fixed minimum working air gap may be provided for in this type injector by the use of a thin shim of nonmagnetic material fastened to the pole piece face so as to provide the necessary gap between the armature and the solenoid pole piece when the injector is open. Alternatively, as disclosed in copending United States patent application Ser. No. 082,893 now U.S. Pat. No. 4,247,052 entitled "Electromagnetic Fuel Injector" filed Oct. 9, 1979 in the name of Leo A. Gray and assigned to a common assignee, a fixed minimum working air gap may be provided for in this type injector by the use of a stepped guide pin provided with a shoulder for abutment against a portion of the armature whereby to limit movement of the armature relative to the solenoid pole piece.

Also in this type injector, the injection nozzle is axially adjustable in the body of the injector whereby the annular valve seat can be moved axially while the injector is flowing calibration fluid on a continuous basis therethrough until the desired flow rate is achieved, thus establishing the stroke length of the armature/-valve for that injector.

Although during such calibration, the flow rate of each injector can be properly calibrated, unfortunately the axial displacement of the injector nozzle during such calibration will cause a corresponding change in the armature spring force, depending on the axial extent of movement of the injector nozzle.

As will be apparent, any change in the armature spring force will effect the dynamic response of the armature upon energization of its associated solenoid and, accordingly, effect the output of the injector.

SUMMARY OF THE INVENTION

Accordingly, a primary object of the present invention is to provide an improved electromagnetic fuel injector construction that advantageously utilizes a guide pin fixed to an armature and slidably in a solenoid pole piece for axial alignment of the movable armature, a stop collar being carried on the guide pin to provide an abutment for limiting axial movement of the armature in one direction so as to establish a predetermined minimum working air gap between the opposed surfaces of the armature and the pole piece of its associated solenoid coil. At least one armature return spring is positioned so as to have one end thereof in abutment against the guide pin whereby to bias the armature away from the pole piece, the opposite end of this one spring abutting against an abutment screw threaded into the pole piece in position so as to be externally accessible whereby the bias force of this spring can be varied as desired.

Another object of the invention is to provide an improved solenoid structure for use in an electromagnetic fuel injector of the type having an injector nozzle assembly with a valve seat that can be axially positioned to obtain a desired fuel discharge rate, wherein the solenoid pole slidably receives one end of a guide pin axially fixed to an armature so as to serve as a guide for axial movement of the armature, a tubular stop being associated with the armature whereby to limit movement of the armature in one axial direction towards the solenoid pole, the end of the guide pin opposite the armature. having one end of a spring in abutment thereagainst to effect movement of the armature in an opposite axial direction, the opposite end of the spring abutting against an abutment screw adjustably threaded into the solenoid pole.

Still another object of the present invention is to provide an electromagnetic fuel injector of the above type which includes features of solenoid construction, operation and arrangement, rendering it easy and inexpensive to manufacture and to calibrate both for the desired fuel flow and for dynamic response, which is reliable in operation, and in other respects suitable for extended use on production motor vehicle fuel systems.

The present invention relates to an electromagnetic fuel injector of the type having an axially adjustable nozzle assembly therein. This nozzle assembly provides an annular valve seat cooperating with a movable valve member defined by a spherical valve element having a flat face on one side thereof which is seated on the flat end face of an armature but which can slide sideways to accommodate misalignment. The armature is biased by an armature return spring means towards a valve closed position and is drawn torwards the pole piece against the bias of this spring by current flow in the solenoid coil. The armature is guided by a small diameter guide pin fixed at one end of the armature and having its opposite end slidably received in a solenoid pole piece. The armature, under the spring bias, locates the valve element in a closed, centered position on the valve seat.

The guide pin supports a tubular stop aperature to provide a stop for the armature in the direction of its travel toward its associated solenoid pole piece so as to provide a minimum air gap between the opposed working surfaces of the solenoid pole pieces and armature. The opposite end of the guide pin from the armature in accordance with the invention, has one end of a spring in abutment thereagainst. The injector is also provided with externally accessible driver-receiving abutment screw which abuts against the opposite end of the spring so as to vary the armature spring load, as desired, for the desired dynamic response of the armature upon energization of the solenoid coil.

For a better understanding of the invention, as well as other objects and further features thereof, reference is had to the following detailed description of the invention to be read in connection with the accompanying drawings.

BRIEF DESCRIPTION OF THE DRAWINGS

FIG. 1 is an enlarged longitudinal, cross-sectional view of an exemplary embodiment of an electromagnetic fuel injector having a solenoid structure in accordance with the invention incorporated therein, the armature guide pin, valve, and the upper end of the abutment screw of the assembly being shown in elevation.

DESCRIPTION OF A PREFERRED EMBODIMENT

Referring now to the FIGURE, an electromagnetic fuel injection, generally designated 1, constructed in accordance with a preferred embodiment of the invention, includes a body 2, a nozzle assembly 3, a valve member 4 and a solenoid assembly 5 as major components thereof.

In the construction illustrated, the body 2, made for example of silicon core iron, is of circular hollow tubular configuration and is of such external shape so as to permit direct insertion, if desired, of the injector into a socket provided for this purpose in either an intake manifold, not shown, or in an injector mechanism of a throttle body injection apparatus, not shown, for an engine.

The body 2, includes an enlarged upper solenoid case portion 6 and a lower end nozzle case portion 7 of reduced external diameter relative to portion 6. An internal cylindrical cavity 8 is formed in the body 2 by a stepped vertical bore therethrough that is substantially co-axial with the axis of the body. In the construction shown, the stepped bore in body 2 provides internal, cylindrical upper and lower intermediate walls 10 and 11, respectively, and a cylindrical lower wall 12. Wall 10 is of an internal diameter so as to loosely slidably receive the large diameter end of an armature 70, to be described, while wall 11 is of greater diameter than wall 10 but of smaller diameter than lower wall 12. Walls 11 and 12, in the embodiment illustrated, are interconnected by an inclined shoulder 14.

Lower intermediate wall 11 defines the outer peripheral extent of a fuel chamber 15 within the body 2. In addition, the body 2 is provided with a plurality of circumferentially equally spaced apart, radial port passages 16 in the nozzle case portion 7 thereof which open through the wall 11 to effect flow communication with the fuel chamber 15. Preferably three such passages are used in the preferred embodiment of the injector illustrated.

The injection nozzle assembly 3 mounted in the lower nozzle case portion 7 of body 2 includes, a seat element-spray tip 20 and a swirl director plate 21, and these elements are positioned in the lower cavity formed by the cylindrical wall 12 in the lower nozzle case portion 7 in a manner to be described.

In the embodiment shown, the seat element-spray tip 20 is provided with a stepped bore therethrough to define an upper cylindrical wall 22 providing a spring cavity, a central axial discharge passage 23 intermediate its ends and a lower cylindrical wall 24 defining a combined swirl chamber-discharge passage for the discharge of fuel from this nozzle assembly. As shown, wall 22 and passage 23 are interconnected by a flat shoulder 25 that terminates at an annular, conical valve seat 26 concentric with and encircling the upper end of the discharge passage 23. The upper surface 27 of the seat element-spray tip 20, in the embodiment illustrated, is downwardly tapered, with this tapered portion being formed at a suitable angle from the horizontal so as to provide an abutment shoulder for the outer peripheral annular edge on one side of an abutment washer 28, for a purpose to be described.

The swirl director plate 21 is provided with a plurality of circumferentially, equally spaced apart, inclined and axially extending director passages 30. Preferably, six such passages are used, although only one such passage is shown in the FIGURE. These director passages 30, of predetermined equal diameters, extend at one end downward from the upper surface of the swirl director plate 21 and are positioned so as to encircle a central raised boss 31 on the upper surface of the director plate 21.

As shown, the diameter of passage 23 in seat element-spray tip 20 is of suitable size so as to receive the swirl director plate 21 therein whereby to locate this element substantially co-axial with the axis of the swirl chamber-discharge passage 23, this plate 21 being supported by the flat wall 32 interconnecting passage 23 and lower wall 24.

In the construction shown, the outer peripheral surface of the seat element-spray tip 20 is provided with external threads 33 for mating engagement with the internal threads **12*a* of the lower wall 12 of body 2. Preferably the threads 12*a* and 33 are of suitable fine pitch whereby a limit axial movement of the seat element-spray tip 20 a predetermined extent as desired, for each full revolution of the seat element-spray tip relative to the body 2**.

The lower face of the seat element-spray tip 20 is provided, for example, with at least a pair of diametrically opposed blind bores 34 of a size so as to slidably receive the lugs of a suitable spanner wrench, not shown, whereby rotational torque may be applied to the seat element-spray tip 20 during assembly and axial adjustment of this element in the body 2.

With the structural arrangement shown, the stroke of the injector can be accurately adjusted by the use of a collapsible abutment member between the upper surface of the valve seat element-spray tip 20 and the shoulder 14 of the body 2. The collapsible abutment member, in the construction shown, is in the form of a flat spring abutment washer 28 of a suitable outside diameter to be slidably received within the lower wall 12 so as to abut against shoulder 14 located a predetermined axial distance from the lower flat end of the pole piece of the solenoid assembly 5, to be described hereinafter. Thus, the abutment washer 28 when first installed would be flat. As thus assembled, the upper outer peripheral edge of the washer 28 would engage against the outer radial portion of the shoulder 14 and its radial inner edge on the opposite side thereof would abut against the upper tapered surface 27 of the seat element-spray tip 20. With the washer 28, seat element-spray tip 20 and its swirl director plate 21 assembled as shown and with the seat element-spray tip 20 in threaded engagement with internal threads 12*a*, these elements can then be axially adjustably positioned upward within the lower end of the body 2.

After these elements are thus assembled, actual adjustment of the injector stroke is made while the injector is flowing calibration fluid on a continuous basis therethrough. During flow of the calibration fluid, an operator, through the use of a spanner wrench, not shown, can rotate the seat element-spray tip 20 in a direction whereby to effect axial displacement thereof in an upward direction with reference to the FIGURE. As the nozzle assembly is moved axially upward by rotation of the seat element-spray tip 20, it will cause the abutment washer 28 to deflect or bend into a truncated cone shape, as shown, to thereby in effect forcibly move the lower abutment surface of the washer 28 upward relative to the fixed shoulder 14 until the desired flow rate is achieved. This thus establishes the correct axial position of the valve seat 26 on seat element-spray tip 20 for the proper stroke length of the armature/valve for that injector. The seat element-spray tip 20 is then secured against rotation relative to the body 2 by any suitable means such as, for example, by laser beam welding at the threaded interface of these elements.

With the above described arrangement, the effective flow orifice of the valve and valve seat interface, as generated by length of injector stroke, is controlled directly within very close tolerances by an actual flow measurement rather than by a mechanical displacement gauge measurement.

An O-ring seal 35 is operatively positioned to effect a seal between the seat element-spray tip 20 and the wall 12. In the construction shown, the seat element-spray tip 20 is provided with an annular groove 36 intermediate its ends to receive the O-ring seal 35.

Flow through the discharge passage 23 in seat element-spray tip 20 is controlled by the valve 4 which is loosely received within the fuel chamber 15. This valve member 4 is movable vertically between a closed position at which it is seated against the valve seat 26 and an open position at which it is unseated, from the valve seat 26, as described in greater detail hereinafter. In the embodiment illustrated, the valve 4 is of an elongated configuration with a lower end having a semi-spherical seating surface for engagement against the valve seat 26. As shown, the valve 4 is made with an enlarged head 37 having a flat surface 37*a* on its upper side for a purpose to be described, and with a cylindrical shank 38 depending therefrom with the lower free end seating surface portion 38*a* thereof being of semi-spherical configuration whereby to be self-centering when engaging the conical valve seat 26.

In the construction shown, a valve spring 40 of predetermined force, is used to aid in unseating of the valve 4 from the valve seat 26 and to hold this valve in abutment against the lower end of its associated armature when in its open position during periods of injection. As shown, the compression valve spring 40 is positioned to loosely encircle the shank 38 of the valve 4. The valve spring 40 is thus positioned to abut at one end, its lower end with reference to the FIGURE, against the shoulder 25 of seat element-spray tip 20 and to abut at its opposite end against the lower surface of head 37 of valve 4. Normal seating and actuation of the valve 4 is controlled by the armature 70 of solenoid assembly 5, in a manner to be described.

To effect filtering of the fuel being supplied to the injector 1 prior to its entry into the fuel chamber 15, there is provided a fuel filter assembly, generally designated 41. The fuel filter assembly 41 is adapted to be suitably secured, as for example by predetermined press fit, to the body 2 in position to encircle the radial port passages 16 therethrough.

The solenoid assembly 5 of the injector 1 includes a tubular coil bobbin 44 supporting a wound wire solenoid coil 45 and having an axial stepped bore therethrough defining an upper cylindrical wall 46 and a lower wall 47 of reduced diameter, the diameter of wall 47 corresponding to the diameter of wall 10 of body 2. Bobbin 44 is positioned in the body 2 between an internal flat shoulder 48 thereof and the lower surface of a circular pole piece 50 that is received at its outer peripheral edge within an enlarged upper wall portion of body 2. Pole piece 50 is axially retained within body 2, as by being sandwiched between an internal flat shoulder 51 and the radially inward spun over upper rim 6*a* of the body. Annular seals 52 and 52*a* are used to effect a seal between the body 2 and the upper, outer peripheral end of bobbin 44 and between the upper end of bobbin 44 and the lower surface of pole piece 50, respectively.

Formed integral with the pole piece 50 and extending centrally downward therefrom is a tubular pole 53. Pole 53 is of a suitable external diameter so as to be slidably received in the bore wall 47 of bobbin 44. The pole 53, is formed integral with the pole piece 50, is of a predetermined axial extent so as to extend a predetermined axial distance into the bobbin 44 in axial spaced apart relation to the shoulder 48. The pole piece 50, in the construction illustrated, is also provided with an upstanding central boss 54.

Pole piece 50 and its integral pole 53 and boss 54 are formed with a central through stepped bore, which in the embodiment illustrated, defines an internal cylindrical lower wall 55, an intermediate wall 56 of reduced diameter relative to wall 55 and an upper enlarged diameter internally threaded wall 57 located within the enlarged boss 54. Walls 55 and 56 are interconnected by a flat shoulder 58.

A tubular guide sleeve 60, with an axial guide bore 61 therethrough is fixed, as by a press fit, into the walls 55 and 56 of pole piece 50 with a shoulder 62 of the guide sleeve abutting against the shoulder 58 of pole piece 50. Guide sleeve 60 can be made of a suitable magnetically hard material for a purpose which will become apparent or alternately, only the surface areas thereof defining the guide bore 61 may be of hardened material.

Pole piece 50 is also provided with a pair of diametrically opposed circular through slots, not shown, located radially outward of boss 54 so as to receive the upright circular studs 63 of bobbin 44, only one such stud being shown in the drawing. Each such stud 63 has one end of a terminal lead 64 extending axially therethrough for connection to a suitable controlled source of electrical power, as desired. The opposite end, not shown, of each such lead 64 is connected (not shown), as by solder, to a terminal end of coil 45.

To effect axial guided movement of the armature 70, to be described, there is provided, in accordance with a feature of the invention, a straight, cylindrical armature guide pin 65, of non-magnetic material, having one end thereof fixed to the armature 70 and its opposite end slidably received in the guide bore 61 of guide sleeve 60.

The armature 70 of the solenoid assembly 5 is of a cylindrical tubular construction with an upper portion 70*a* and a lower reduced diameter portion 70*b*. Upper portion 70*a* is of a suitable outside diameter whereby this armature is loosely received within the intermediate wall 10 of body 2 and in the lower wall 47 in bobbin 44. The armature 70 is formed with a stepped central bore therethrough to provide an upper spring cavity portion defined by an internal cylindrical upper wall 71 of a suitable predetermined inside diameter and a lower cylindrical bore wall 72 portion of a preselected smaller inside diameter than that of wall 71 and of a size whereby to receive the lower end of guide pin 65 which is secured to the armature as by a press fit in bore wall 72. In effect, guide pin 65 serves as an extension of the armature 70 whereby it is axially guided for movement relative to pole 53 by having the guide pin 65 slidably received in the guide bore 61 of guide sleeve 60 fixed in the pole piece. As shown, the wall 71 and the guide bore wall 72 of the armature 70 are interconnected by a flat shoulder 73 for a purpose which will become apparent.

The armature 70 at its lower end is provided with a central radial extending through narrow slot 74 formed at right angles to the axis of the armature. At its opposite or upper end, the armature 70 is also provided with at least one right angle, through narrow slot 75 to effect hydraulic pressure relief during movement of the armature toward the associated end of pole 53.

Preferably, in order to effect additional hydraulic pressure relief during upward movement of the armature 70 toward the lower end of pole 53, there is provided at least one axial groove 76 on the outer peripheral surface of the pole 53 to provide a passage that is in communication with the chamber in which the armature moves via the lower end of pole 53 to the annular drain chamber 77 defined by the inner wall 46 of bobbin 44 and the exterior peripheral wall of pole 53. The drain chamber 77 is connected by at least one radial passage 78 in bobbin 44 to a groove 80 provided on the outer peripheral surface of the bobbin so as to be aligned for fluid communication with a radial drain port 81 provided in the body 2. A circular fuel filter assembly 82 is suitably secured in the drain port 81.

In the embodiment illustrated, an armature stop sleeve 83, of suitable magnetic hard material, and of a predetermined axial extent is received within the opening of the armature 70 defined by the upper wall 71 so as to encircle the guide pin 65 with one end thereof abutting against the shoulder 73 and its opposite end projecting a predetermined axial distance above the upper end surface of the armature 70 so as to serve as an abutment stop whereby to limit upward movement of the armature toward the opposed lower working surface of pole 53 whereby to establish a fixed minimum working air gap between the opposed working surfaces of the pole and armature.

As shown, the armature 70 is slidably positioned for vertical axial movement as guided by the armature guide pin 65 between a lowered position, as shown, at which it abuts against the upper flat surface 37*a* of valve 4 to force the valve into seating engagement with the valve seat 26 and a raised position at which the upper end surface of the armature stop sleeve 83 abuts against the lower face of sleeve 60.

When the armature 70 is in its lowered position, the position shown in the drawing, a working air gap is established between the lower end of the pole 53 and the upper end of the armature 70 by axial positioning of the nozzle assembly 3 in the manner described hereinabove. The axial extent of the upper end surface of the armature stop sleeve 83 from the upper end surface of the armature 70 is preselected as desired, whereby a minimum fixed working air gap will exist between the upper end surface of armature 70 and the lower end surface of pole 53 when the armature 70 is moved upward, from the position shown in the drawing.

Now in accordance with the invention, the armature 70 is normally biased to its lowered position, as shown, with the valve 4 seated against its associated valve seat 26 by means of a spring biasing means, which would include at least one armature return spring positioned so as to abut against the free end of the guide pin whereby the force of at least this spring can be adjusted, as desired, through a suitable externally accessible adjusting means.

For this purpose, an armature return spring 84 is received in the intermediate wall 56 portion of the pole piece that is positioned so as to have one end thereof abut against the upper free end of the guide pin 65. To effect centering and retention of this end of the spring 84, the guide pin is preferably provided with an upstanding concentric spring guide 66. The opposite end of the armature return spring 84, in the embodiment illustrated, is thus positioned to abut against a shoulder 85 provided by a blind bore in the shank 86 of an abutment screw 87. Abutment screw 87 is adjustably threadedly engaged in the upper internal threaded wall 57 of pole piece 50.

Abutment screw 87 is provided with a suitable, externally accessible, internal driver recess, such as the screwdriver slot 88 shown, whereby the abutment screw 87 can be rotated, as desired to effect axial displacement thereof in either an up or down direction as desired, with reference to the drawing whereby the biasing force of the armature return spring 84 can be varied, as desired.

Preferably, and as shown in the preferred embodiment illustrated, a second spring 90 is also used in corporation with the armature return spring 84 to effect normal biasing of the armature 70 to the position shown. As shown, spring 90 is positioned within the spring cavity of the armature 70 so as to loosely encircle the armature stop sleeve 83, with one end of this spring 90 thus positioned to abut against the flange surface 83*a* of the armature stop sleeve 83. The opposite end of the spring 90, in the embodiment illustrated, abuts against the lower face of the guide sleeve 60 positioned in pole 53. Thus this spring 90, in addition to normally assisting in the biasing of the armature 70 to the position shown, is also operative to retain the armature stop sleeve 83 in abutment against the shoulder 73 of armature 70 and to force and retain, if necessary, the guide sleeve 60 in abutment against the shoulder 58 of pole 53.

The combined force of the armature return spring 84 and of spring 90 will be of a predetermined force value greater than that of the valve spring 40 whereby the springs 84, 90 will be operative to effect seating of the valve 4 against the normal bias of the valve spring 40. For ease in effecting the desired biasing force against the armature 70 so as to obtain the desired dynamic response thereof in its movement towards and away from the working face of the pole 53, the force of the spring 84 should constitute 50 to 70 percent of the total biasing force applied against the armature 70 to move it to the position shown.

However it will be apparent to those skilled in the art, that depending on the particular application in which the injector is to be used, the force of armature return spring 84 can be preselected, as desired, to be any percentage of the total armature return spring force and, accordingly, in certain applications, spring 90 could be eliminated, if desired, so that the required biasing force applied against the armature 70 would be that of a single armature return spring 84 of the desired force value.

As shown, the shank 86 of the abutment screw 87 is of a suitable diameter so as to be slidably received within the intermediate wall 56 of the pole piece 50, the shank being provided with a suitable annular groove 86*a* to receive an O-ring seal 91 effecting a fluid tight seal between the shank 86 and the intermediate wall 56.

The cavity defined by the intermediate wall 56 in the pole piece 50 located between the lower end of the shank 86 and the upper end of the guide sleeve 60 is in fluid communication via an inclined drain port 92 extending through the intermediate wall 56 so as to open into the drain chamber 77.

The above described stuctural arrangement allows the minimum working air gap to be established and fixed by means of the armature stop sleeve 83; and, allows the stroke of the armature 70 to be adjusted by axial movement of the nozzle assembly 3 so as to obtain the desired discharged flow rate, all in the manner described hereinabove.

After these parameters have been established, the armature return spring 84 load, incorporated with the bias of the spring 90, can then be adjusted so as to obtain a desired dynamic response time by the rotation of the abutment screw 87, through the use of a suitable tool, such as a screwdriver engaging the screwdriver slot 88 in the externally accessible top thereof, whereby this screw can be moved up or down axially within the injector.

While the invention has been described with reference to a particular embodiment disclosed herein, it is not confined to the details set forth since it is apparent that various modifications can be made by those skilled in the art without departing from the scope of the invention. For example, instead of using the guide sleeve 60 with the guide bore 61 therein receiving the guide pin 65 to effect axial alignment of the armature 70, the pole 53 and pole piece 50 could be appropriately machined to provide a guide bore therein for reciprocably guiding and receiving the guide pin 64, with the bore wall thus formed suitably surface hardened to extend its durability for extended use of the injector as required for a particular application.

Accordingly, this application is therefore intended to cover such modifications or changes as may come within the purpose of the invention as defined by the following claims.

The embodiments of the invention in which an exclusive property or privilege is claimed are defined as follows:

1. An electromagnetic fuel injection valve having a housing means defining a generally cylindrical bore terminating at a fuel discharge passage at one end thereof, a solenoid pole piece fixed in the opposite end of said bore in said housing means, said solenoid pole piece means having a stepped aperture therethrough, a cup-shaped armature loosely positioned in said bore for movement in opening and closing directions to open and close the fuel discharge passage, a guide pin fixed to and axially extending from said armature in sliding engagement in said stepped aperture, a first spring in said bore effective at one end to bias said armature in said closing direction, a tubular abutment member positioned in said armature to loosely encircle said guide pin so as to extend outward a predetermined axial distance from said armature for engagement with said pole piece whereby to fix the extent of armature movement in said opening direction, an externally accessible, adjustable screw threadingly received in said stepped aperture, and a spring means, including at least one spring positioned in said stepped aperture so as to abut at one end against said adjustable screw and effective at its opposite end to engage said guide pin whereby to bias said armature in said closing direction.

2. An electromagnetic fuel injection valve having a housing means defining a generally cylindrical bore terminating at a fuel discharge passage at one end thereof, a solenoid pole piece means fixed in the opposite end of said bore in said housing means, said solenoid pole piece having a stepped aperture therethrough, a cup-shaped armature loosely positioned in said bore for movement in opening and closing directions to open and close the fuel discharge passage, a guide pin fixed to and axially extending from said armature in sliding engagement in said stepped aperture, a first spring in said bore effective to one end to bias said armature in said closing direction, a tubular abutment member positioned in said armature to loosely encircle said guide pin so as to extend outward a predetermined axial distance from said armature for engagement with said pole piece whereby to fix the extent of armature movement in said opening direction, an externally accessible, adjustable screw received in said stepped aperture, and a second spring in said stepped aperture abutting at one end against said adjustable screw and effective at its opposite end to engage said guide pin whereby to assist said first spring in biasing said armature in said closing direction.

3. An electromagnetic fuel injection valve having a housing means defining a generally cylindrical through bore threaded at one end, a nozzle assembly threaded in said one end of said bore of said housing means, said nozzle assembly defining a fuel discharge passage at said one end, a solenoid pole piece fixed in the opposite end of said bore in said housing means, said solenoid pole piece means having a stepped aperture therethrough that is threaded at one end, a guide sleeve with an axial guide bore fixed in the opposite end of said stepped aperture, a cup-shaped armature loosely positioned in said bore for movement in opening and closing directions to open and close the fuel discharge passage, a guide pin fixed to and axially extending from said armature in sliding engagement in said guide bore, a first spring in said bore effective at one end to bias said armature in said closing direction, a tubular abutment member operatively associated with said armature to provide an abutment surface that extends outboard a predetermined axial distance from said armature for engagement with said pole piece upon movement of said armature toward said pole piece whereby to provide a fixed minimum working air gap between opposed working surfaces of said armature and said pole piece, an externally accessible, adjustable screw means threadedly received in said threaded one end of said stepped aperture, and a spring means including at least one spring positioned in said stepped aperture to abut at one end against said adjustable screw means and effective at its opposite end to engage said guide pin whereby to normally bias said armature in said closing direction.

* * * * *